United States Patent [19]

Ward

[11] Patent Number: 4,970,937

[45] Date of Patent: Nov. 20, 1990

[54] ANTI-ICE PROTECTION FOR PROJECTILES

[75] Inventor: Norman R. Ward, Herts, England

[73] Assignee: British Aerospace Public Limited Company, London, England

[21] Appl. No.: 354,416

[22] Filed: May 19, 1989

[30] Foreign Application Priority Data

May 20, 1988 [GB] United Kingdom ..... 8811983

[51] Int. Cl.[5] ..... F41F 3/04

[52] U.S. Cl. ..... 89/1.817; 220/375

[58] Field of Search ..... 89/1.817, 1.812, 1.87, 89/1.809; 220/315, 316, 326, 375, 341

[56] References Cited

U.S. PATENT DOCUMENTS

| | | | |
|---|---|---|---|
| 3,120,879 | 2/1964 | Warner | 220/326 |
| 3,158,062 | 11/1964 | Feiler | 89/1.817 |
| 3,182,553 | 5/1965 | Choate et al. | 89/1.817 |
| 3,745,876 | 7/1973 | Rocha | 89/1.817 |
| 3,789,729 | 2/1974 | Aupy | 89/1.817 |
| 3,807,274 | 4/1974 | Cohen | 89/1.810 |
| 4,134,328 | 1/1979 | Asp et al. | 89/1.817 |
| 4,373,420 | 2/1983 | Piesik | 89/1.812 |
| 4,455,917 | 6/1984 | Shook | 89/1.817 |
| 4,471,684 | 9/1984 | Johnson et al. | 89/1.817 |
| 4,655,363 | 4/1987 | Neat | 220/375 |

FOREIGN PATENT DOCUMENTS

| | | | |
|---|---|---|---|
| 2036268 | 6/1980 | United Kingdom | 89/1.817 |

*Primary Examiner*—David H. Brown

*Attorney, Agent, or Firm*—Cushman, Darby & Cushman

[57] ABSTRACT

This invention relates to an anti-ice protector for use on open-ended projectile launch tubes. The protector is made of resiliently deformable material and is hinged to permit the protector being removed by the emerging projectile.

5 Claims, 3 Drawing Sheets

FIG. 8A
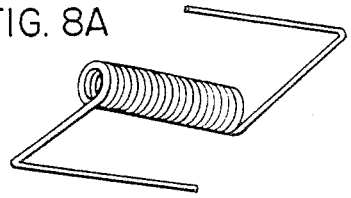
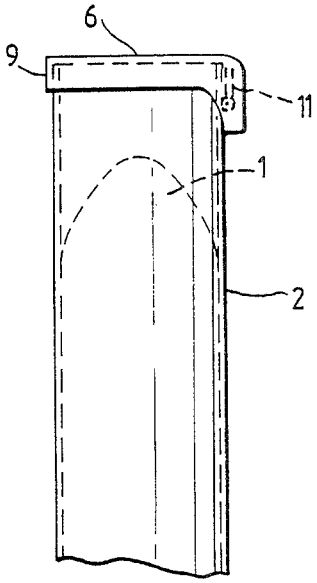
FIG.8.
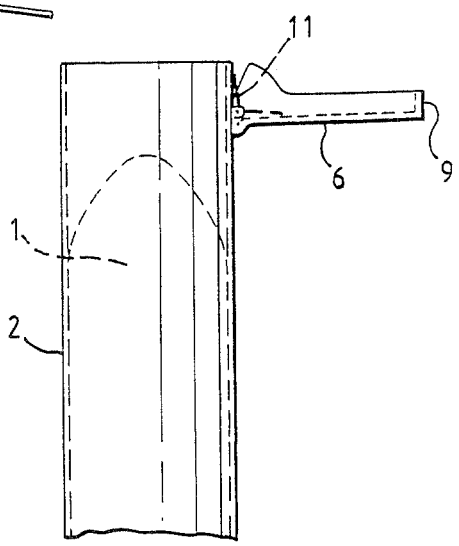
FIG. 9.
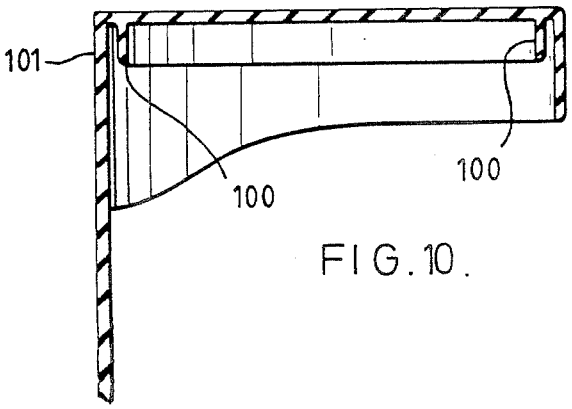
FIG. 10.

ANTI-ICE PROTECTION FOR PROJECTILES

This invention relates to anti-ice protection for projectiles launched from a launching tube, particularly but not exclusively from a launching tube mounted on a helicopter or an aircraft, and where there must be no obstruction of the launch tube which would adversely affect the guidance of the projectile.

Open-ended launcher exit tubes, say on a helicopter, may accrete ice and pack with snow under certain climatic conditions. To avoid this, it has been proposed to cover the open end of the tube with a protective cap made of silicone rubber and secured by a tie wrap. The design of the cap is such that it provides a flexible diaphragm over the launch tube which by virtue of both the silicone material itself and its flexibility especially during flight is both water and snow proof and is not conductive to the accretion of ice. However, removal of the cap may only be made manually, which is inconvenient and very time consuming.

Fixed diaphragms of flexible or frangible materials which need to be punctured by the projectile on exit can give rise to both safety and reliability problems related to both the projectile and its launching platform. Flexible diaphragms need to be strong enough to withstand the maximum forward airspeed of the aircraft without accidental fracture and be of such a strength as to be readily punctured by the projectile at launch. Flexible diaphragms after puncture at launch will, through their elastic memory tend to return to cover the front of the exit tube possibly interfering with any projectile guidance wire or control signals. Frangible diaphragms can, on being shattered, create debris which can be ingested into engine air intakes and then cause damage or can be swept up into the main and tail rotors of a helicopter again with serious effects, especially if such debris is carrying or releasing accreted ice. Many frangible materials such as polystyrene and glass fibre reinforced plastic (GRP) accrete ice quite readily on their surfaces during flight in icing conditions.

One object of the present invention is to provide a closure for the forward end of launcher tubes which affords the necessary anti-water, anti-ice protection, and which is removed automatically by the projectile at launch, leaving no obstruction to the front exit tube of the launcher and thus producing no debris.

According to one aspect of the present invention there is provided a closure for protecting the exit end of a projectile launch tube comprising a cap made of resiliently deformable material and operable for being removably engaged over said end of said launch tube, and a force applying member connected to one side of the cap for initially holding the cap in position over the tube end, for acting as a hinge permitting the cap to be pushed away from the tube end by an emerging projectile and, when the cap has swung around the hinge position to a predetermined angle, for becoming operable to move the cap bodily away from the tube.

Preferably, said cap is moulded from silicon rubber to the shape of the launch tube end and said tension applying member comprises a rubber strap of the same material or a helical torsion spring.

Reference will now be made by way of example to the accompanying drawings, in which.

Figure 1:
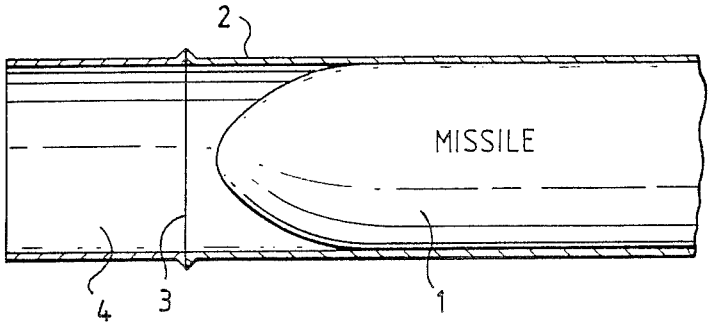
FIG. 1. (PRIOR ART)
FIG. 1 is a diagram of a missible within a launcher tube.
Figure 2:
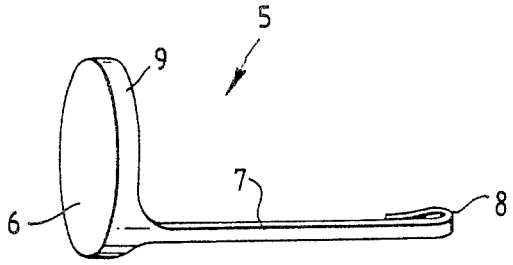
FIG. 2 is a diagram of a launch tube cap according to the present invention.
Figure 3:
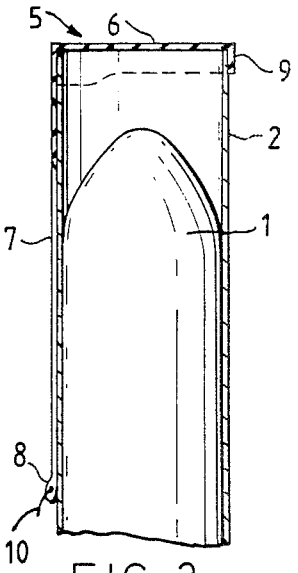
FIG. 3–7 are diagrams of a launcher tube fitted with the cap shown in FIG. 2 and depicting a missile being launched; and, FIGS. 8 and 9 are diagrams of another method of removing the cap from the front of the launch tube after missile launch.

In FIG. 1, a missile 1 is held in a laucher tube 2 which is fitted to a helicopter (not shown). The launcher tube may include a moisture protective vapour barrier 3 and a front portion 4 which is empty. In icing conditions as the helicopter flies, the front portion 4 may fill with snow and/or ice and due to the speed of the helicopter may become hard packed. Ice may also begin to accrete in increasing quantity on the exposed edges of the launch tube. To prevent this, the protective end closure of FIG. 2 is used. The closure comprises a cap 5 having a flat circular diaphragm 6 and a short cylindrical wall 9. The cap is moulded of silicon rubber to suit the shape of the launcher tube. The device also includes a rubber tensioner 7 with an integral attachment loop 8.

Figure 4:
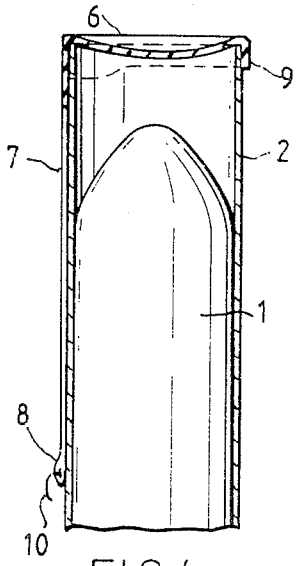

In FIGS. 3–7, the cap 5 is placed over the end of the launch tube. The rubber tensioner 7 is stretched so that the loop 8 may be attached onto a suitable anchor point 10, such that the rubber tensioner 7 is under tension by a length at least equivalent to the diameter of the protective cap, so that the diameter of the cap plus the length of the tensioner 7 is equivalent to the distance from the anchor point 10 to the open end of the launch tube. In normal forward flight the diaphragm 6 flexes as shown in FIG. 4 due to the forward air speed and the elastic properties of the silicone rubber, any ice which forms on the diaphragm is constantly being shed. This will be particularly noticeable if the helicopter comes to the hover position in order to fire the missile 1 within the launcher, the cap returns to its normal shape, thereby shedding any ice that may have formed.

Figure 5:
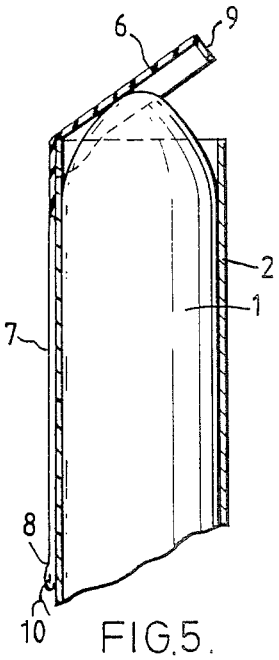
Figure 6:
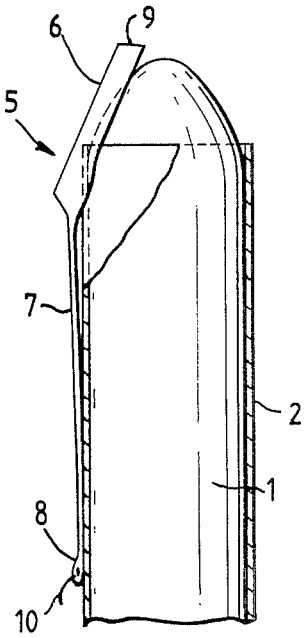
Figure 7:
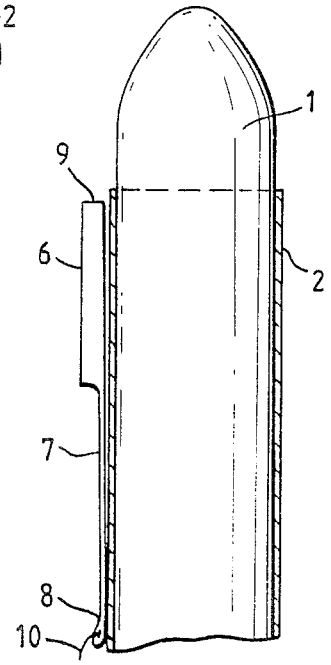

In FIGS. 5–7 as the missile 1 is launched it pushes up the cap 5 which acts as if hinged due to the rubber tensioner 7 being stretched. The length of the cylindrical walls 9 of the cap are such as not to be caught on the nose of the missile 1. As soon as the cap 6 is pushed to a release angle the rubber tensioner 7 retracts the cap clear of the front of the launch tube and the missile launch proceeds unhindered.

In another form of the invention the same configuration of silicone rubber cap has the tensioner 7 absent and replaced with a helical torsion spring 11. As shown in FIGS. 8 and 8A the spring biases the cap open, as does the tensioner 7 in the previous embodiment, while the skirt 9 holds the cap on the tube against the rightward pull of spring 11 in FIG. 8. The method of operation during the launch of the projectile is identical as for the cap with the integral tensioner. However, as soon as the cap release angle is reached the cap flies clear of the front of the launch tube under the action of the spring 11.

In this embodiment of the invention it is important that the spring 11 was adequately protected from adverse climatic conditions.

It should be noted that the rubber tensioner 7 may be replaced by any suitable tension strap, for example a cord attached to a tensioned reel onto which the cord winds as the release angle of the cap is reached or a metal spring sealed within a silicone rubber tube.

It should also be noted that the cap may be manufactured from resilient elastic materials other than silicone rubber providing said alternative materials have satisfactory strength, elasticity and low temperature characteristics.

FIG. 10 of the accompanying drawings shows an improvement to the ice caps which would be an advantage if the caps were subjected to pressure from a launching adjacent missile, where such pressure was higher than that experienced from the result of say forward flight. The modification is fairly simple, but as can be seen from the drawings presents more resistance to external air flow trying to push the caps inwards but does not contribute significantly to the "push-off" forces. In particular, the incorporation of say ⅜" high inner wall 100 which fits inside the end of the launch tube (not shown) tends to cause the cap 101 to resist being blown inwards. Inward pressure makes the small inner wall grip the inside diameter of the launch tube. The additional wall does not affect push-off forces. This feature could be incorporated in any of the previously described embodiments.

I claim:

1. A closure for protecting the exit end of a projectile launch tube comprising a launch tube end cap made of resiliently deformable material and hinge means at one side of the cap for permitting the cap to be pushed away from the tube end by an emerging projectile, the hinge means comprising force applying means for becoming operable, after the cap has been pushed away as aforesaid, to move the cap bodily away from the tube end.

2. A closure for protecting the exit end of a projectile launch tube comprising:

a cap made of resiliently deformable material for removable engagement over said end of said launch tube, and tension applying means on one side of the cap for initially holding the cap in position over the tube end, for acting as a hinge permitting the cap to be pushed away from the tube end by an emerging projectile and, when the cap has swung around the hinge position to a predetermined angle, for becoming operable to move the cap bodily away from the tube end.

3. A closure according to claim 1, wherein said cap is moulded from silicone rubber to fit the shape of the launch tube end.

4. A closure according to claim 1, wherein said applying means comprises a rubber tensioner.

5. A closure according to claim 1 or claim 2, wherein said applying means comprises a helical torsion spring.

* * * * *